US010488150B1

(12) United States Patent
Slagel

(10) Patent No.: US 10,488,150 B1
(45) Date of Patent: Nov. 26, 2019

(54) FIREARM RECOIL PAD ASSEMBLY

(71) Applicant: Michael J. Slagel, Peoria, AZ (US)

(72) Inventor: Michael J. Slagel, Peoria, AZ (US)

( * ) Notice: Subject to any disclaimer, the term of this patent is extended or adjusted under 35 U.S.C. 154(b) by 0 days.

(21) Appl. No.: 16/122,202

(22) Filed: Sep. 5, 2018

Related U.S. Application Data

(60) Provisional application No. 62/554,563, filed on Sep. 5, 2017.

(51) Int. Cl.
*F41C 23/00* (2006.01)
*F41C 23/08* (2006.01)

(52) U.S. Cl.
CPC ..... *F41C 23/08* (2013.01)

(58) Field of Classification Search
CPC ..... F41C 23/00; F41C 23/06; F41C 23/08; F41C 23/18; F41C 23/20
USPC ..... D22/111
See application file for complete search history.

(56) References Cited

U.S. PATENT DOCUMENTS 1,088,362 A * 2/1914 Perkins ..... F41C 23/08 42/73
1,331,074 A * 2/1920 Marble ..... F41C 23/20 42/71.01
2,300,738 A * 11/1942 Ammann ..... F41C 23/08 42/73
D274,541 S * 7/1984 McCone ..... D22/111
5,009,021 A * 4/1991 Nelson ..... F41C 23/14 42/73
6,497,064 B1 * 12/2002 Keaton ..... F41C 23/20 42/71.01
7,536,819 B2 * 5/2009 Popikow ..... F41C 23/14 42/71.01
8,776,423 B2 * 7/2014 Paquette ..... F41C 23/14 42/73
9,417,033 B2 * 8/2016 Wood ..... F41C 23/20

FOREIGN PATENT DOCUMENTS

DE 20201105254 U1 * 2/2012
EP 1396697 A2 * 3/2004 ..... F41C 23/08
WO WO000005399 * 9/2000

* cited by examiner

*Primary Examiner* — Gabriel J. Klein
(74) *Attorney, Agent, or Firm* — Thomas W. Galvani, P.C.; Thomas W. Galvani

(57) ABSTRACT

A firearm recoil pad assembly includes a base plate, a pad plate, and a pad, and can be secured to the buttstock of a firearm. The base plate has a bore formed therethrough, and the pad plate has a bore formed therethrough. A bolt extends through the bores in the base plate and the pad plate and couples with a nut to secure the pad plate to the base plate. The pad is affixed to the pad plate and includes a rear face formed with compression channels extending across the rear face, and opposed left and right sides. The rear face of the pad is canted toward one of the left and right sides.

19 Claims, 5 Drawing Sheets

FIREARM RECOIL PAD ASSEMBLY

CROSS-REFERENCE TO RELATED APPLICATIONS

This application claims the benefit of U.S. Provisional Application No. 62/554,563, filed Sep. 5, 2017, which is hereby incorporated by reference.

FIELD OF THE INVENTION

The present invention relates generally to firearms, and more particularly to firearm accessories.

BACKGROUND OF THE INVENTION

Newton's Second Law establishes that all firearms, when fired, will recoil. Conservation of momentum requires that as a bullet is accelerated and propelled out the barrel of a gun, a force will be imparted in an opposite direction. This resultant force is equal to the rate of change of the bullet's momentum, and it is distributed among many elements in and on the firearm, such as the spent casing. Primarily, though, it acts within the chamber of a firearm as a recoil force. Recoil force causes the firearm to recoil or move backward quickly. "Felt recoil" is the force the shooter feels when the firearm moves backward into the shooter's hand, arm, and shoulder.

For some firearms, felt recoil can be very small. Some small-caliber handguns or rifles have little to no detectable felt recoil. Others, of course, have massive felt recoil. Prolonged use of such weapons is burdensome: they are difficult to control, rough on the body, and often need to be re-aimed each time after firing.

Various efforts have been made to reduce recoil and felt recoil. Some firearm systems use an open chamber to mitigate recoil. For example, recoilless rifles and some shoulder-mounted rocket launchers employ a barrel which is open at opposed ends. The projectile is held in the barrel until firing, at which point the combustion gases are exhausted out the open back of the barrel and the projectile is propelled out the front. Because the combustion gases do not impact any back wall of a chamber, little recoil force is applied to the weapon. As a result, the shooter experiences very little felt recoil.

Recoilless rifles fire very large artillery which would otherwise produce an uncontrollable or possibly injurious recoil force; the mitigation of their recoil is absolutely necessary. Most weapons, however, are not designed for the purpose of eliminating felt recoil. They fire sufficiently small projectiles that the felt recoil can be handled. Nevertheless, mitigation of recoil force and its deleterious effects in such weapons is still desirable, as it allows the shooter to fire more frequently, longer, and with greater accuracy.

SUMMARY OF THE INVENTION

A firearm recoil pad assembly includes a base plate, a pad plate, and a pad, and can be secured to the buttstock of a firearm. The base plate has a bore formed therethrough, and the pad plate has a bore formed therethrough. A bolt extends through the bores in the base plate and the pad plate and couples with a nut to secure the pad plate to the base plate. The pad is affixed to the pad plate and includes a rear face formed with compression channels extending across the rear face, and opposed left and right sides. The rear face of the pad is canted toward one of the left and right sides.

The above provides the reader with a very brief summary of some embodiments discussed below. Simplifications and omissions are made, and the summary is not intended to limit or define in any way the scope of the invention or key aspects thereof. Rather, this brief summary merely introduces the reader to some aspects of the invention in preparation for the detailed description that follows.

BRIEF DESCRIPTION OF THE DRAWINGS

Referring to the drawings.

DETAILED DESCRIPTION

Figures 1A, 1B, 1C:
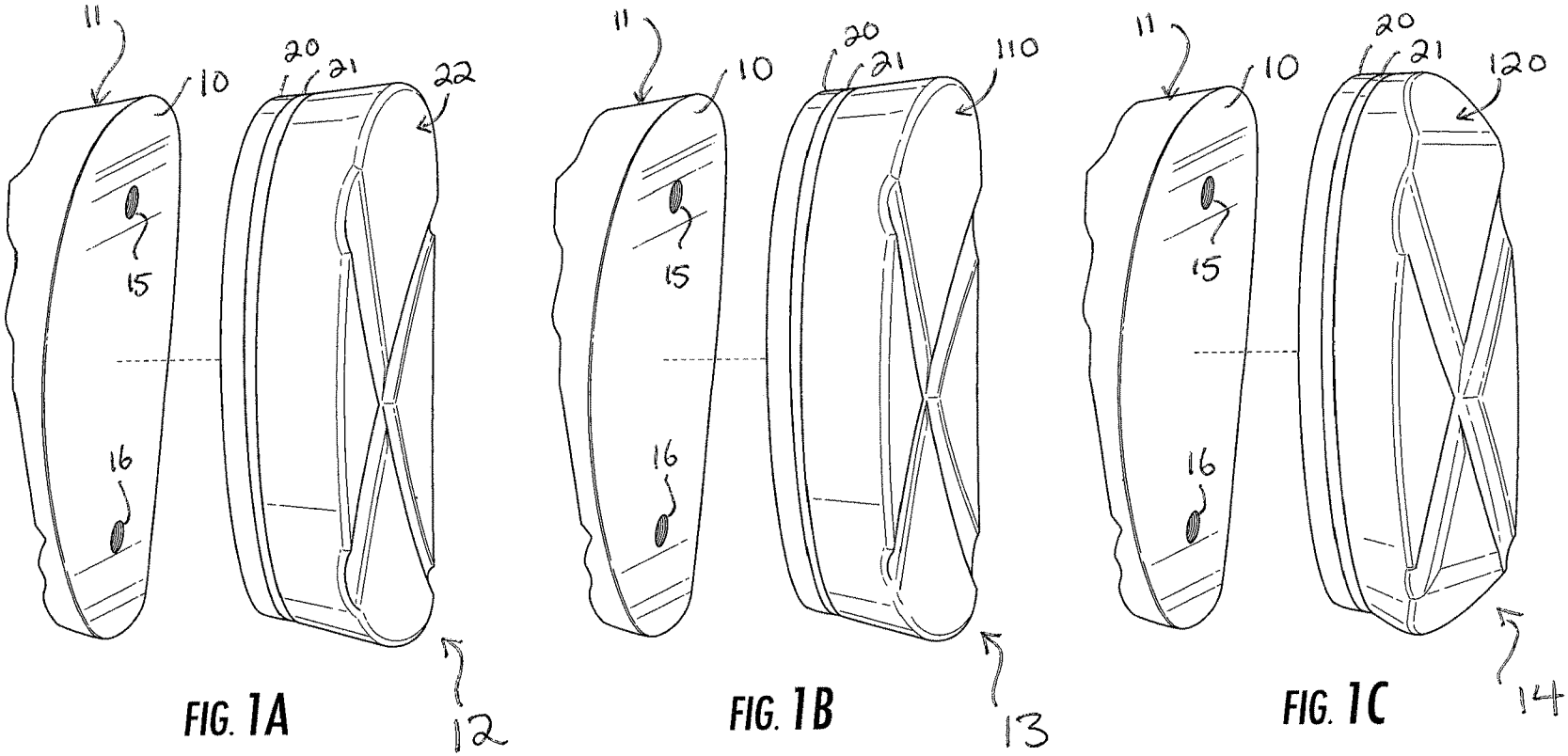
FIGS. 1A, 1B, and 1C are partially-exploded views of firearm recoil pad assemblies, each applied to the buttstock of a firearm.

Reference now is made to the drawings, in which the same reference characters are used throughout the different figures to designate the same elements. FIGS. 1A, 1B, and 1C are exploded rear perspective views illustrating three different firearm recoil pad assemblies mounted to the buttstock 10 of a firearm 11, each useful for mitigating the felt recoil of the firearm 11 when it is fired. FIG. 1A shows a left-hand rifle recoil pad assembly 12, FIG. 1B shows a right-hand rifle recoil pad assembly 13, and FIG. 1C shows a shotgun recoil pad assembly (hereinafter, respectively, "assembly 12," "assembly 13," and "assembly 14").

Figure 2A:
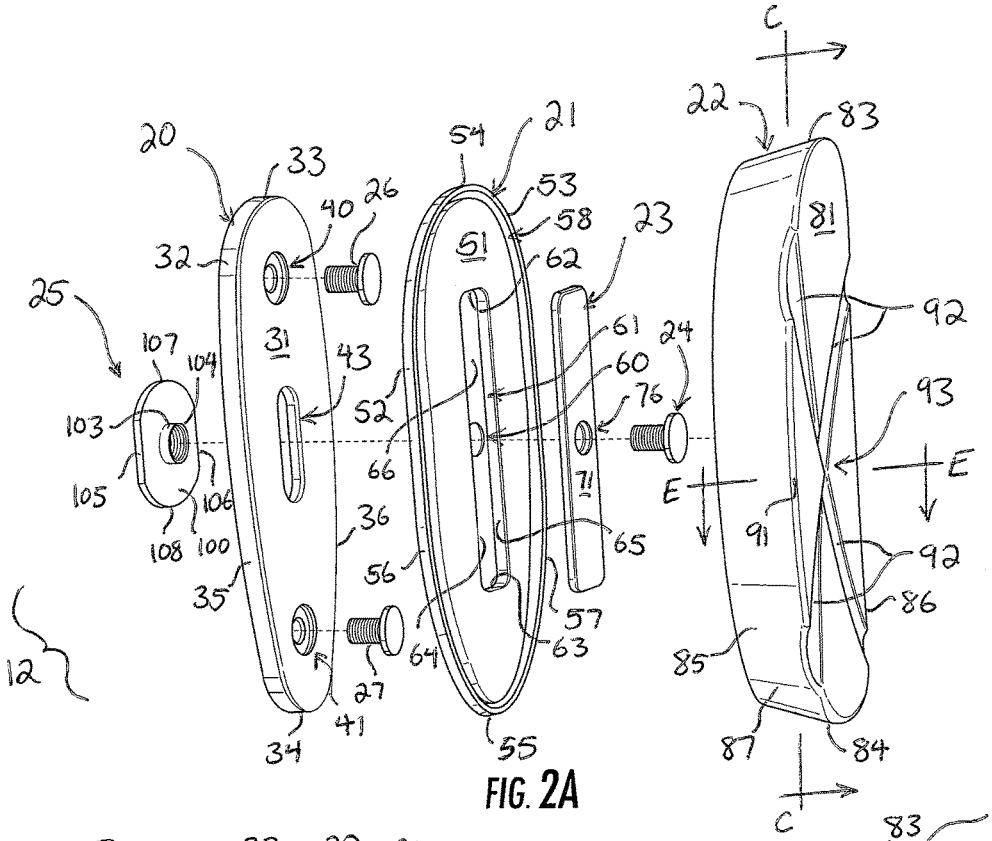
FIGS. 2A and 2B are exploded rear and front perspective views, respectively, of the firearm recoil pad assembly of FIG. 1A.
Figure 2B:
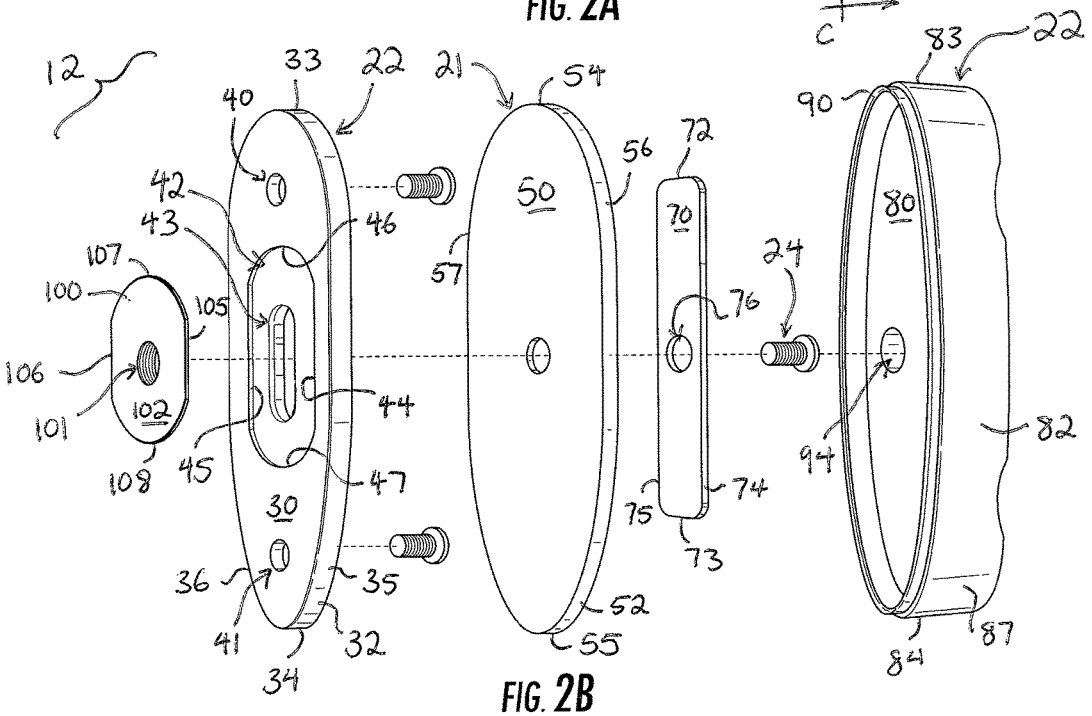

Turning first to the assembly 12, FIGS. 2A and 2B are exploded views of the assembly 12 itself, shown removed from the firearm 11. The assembly 12 includes a base plate 20, a pad plate 21, and a pad 22, all of which correspond to each other and to the buttstock 10 in size and shape. The assembly 12 further includes a rigid member 23 and an adjustment bolt 24 and complemental nut 25. Most buttstocks 10 are formed with two threaded bores 15 and 16 (as shown in FIG. 1A) so that accessories such as pads can be affixed to the back of the firearm 11; this assembly 12 also includes fasteners or threaded bolts 26 and 27 for threadably engaging with the bores 15 and 16. These bolts 26 and 27 allow a shooter to mount the base plate 20 of the assembly 12 to the buttstock 10, and the adjustment bolt 24 and nut 25 then allow the shooter to adjust and customize the location and orientation of the pad plate 21 and the pad 22 on the base plate 20, thereby increasing the surface area of the pad 22 in contact with the shooter and improving the flushness of the pad 22 against the shooter. This allows the shooter to select a custom and comfortable interface with the firearm 11 to fire more frequently, longer, and with greater accuracy.

The base plate 20 has a body with a roughly oval shape, a front face 30 (shown in FIG. 2B), an opposed rear face 31 (shown in FIG. 2A), and a perimeter edge 32 defined between the front and rear faces 30 and 31. The perimeter edge 32 and the shape of the base plate 20 correspond to the shape of the buttstock 10, so that when the base plate 20 is registered and mated to the buttstock 10, the base plate 20 is a contiguous extension of the buttstock 10. In the embodiment of the firearm 11 shown throughout the drawings, the buttstock 10 is oval but is slightly narrower or pointed at its bottom than at its top. The base plate 20 is preferably formed from a strong, rugged, durable material or combination of materials, such as high-density plastic or metal.

The base plate 20 has a top 33, an opposed bottom 34, and two sides 35 and 36 which extend therebetween. Formed entirely through the body of the base plate 20, from the front face 30 to the rear face 31, and at a generally intermediate location between the sides 35 and 36, are two holes 40 and 41. The hole 40 is proximate to the top 33 of the base plate 20, and the hole 41 is proximate to the bottom 34, respectively. The holes 40 and 41 are preferably unthreaded, are normal to the front and rear faces 30 and 31, and are countersunk on the rear face 31 to seat the enlarged heads of the bolts 26 and 27 so as to lie flush with the rear face 31 when fully engaged in the holes 40 and 41.

As seen in FIG. 2B, an oval recess or depression 42 is formed into the front face 30 of the base plate 20 around a bore or slot 43. The slot 43 is centrally located in the body of the base plate 20 between the top 33 and bottom 34 and between the sides 35 and 36. The slot 43 is elongate and has a long dimension oriented along a line extending between the top 33 and bottom 34 of the base plate 20. The slot 43 has parallel straight sides, flanked by a semi-circular top and a semi-circular bottom. The width of the slot 43 is constant between its sides. The slot 43 has a larger length than width. The slot 43 is not threaded; it has an inner wall which is smooth.

The slot 43 extends entirely through the body of the base plate 20, normal to the front and rear faces 30 and 31. The depression 42, on the other hand, is a blind recess extending slightly into the front face 30 only. The depression 42 encircles or surrounds the slot 43 and roughly corresponds to the slot 43 in shape. Like the slot 43, the depression 42 is elongate and has a long dimension oriented along a line extending between the top 33 and bottom 34 of the base plate 20. The depression 42 has parallel, straight sides 44 and 45, flanked by a semi-circular top 46 and a semi-circular bottom 47. The width of the depression 42 between its sides 44 and 45 is constant and is less than the distance between the top 46 and bottom 47 of the depression 42.

Referring now to both FIGS. 2A and 2B, the pad plate 21 is mounted to the base plate 20. The pad plate 21 has a body with a roughly oval shape, a front face 50 (shown in FIG. 2A) and an opposed inset rear face 51 (shown in FIG. 2B). A perimeter edge 52 is defined on an upstanding lip 53 continuously encircling the rear face 51. The shape of the pad plate 21 corresponds to the base plate 20 so that the pad plate 21 can be a contiguous extension of the base plate 20 when mounted thereto and oriented in a registered fashion, as will be explained. The perimeter edge 52 is normal to the front and rear faces 50 and 51. The pad plate 21 is preferably formed from a strong, rugged, durable material or combination of materials, such as high-density plastic or metal.

The front face 50 of the pad plate 21 is smooth and flat across its entire surface within the perimeter edge 52. The rear face 51 is inset, or separated from the upstanding lip 53, by a recessed channel 58 extending continuously around the pad plate 21 and just set in from the perimeter edge 52. The rear face 51 and the upstanding lip 53 are flush with each other. The pad plate 21 has a top 54, an opposed bottom 55, and opposed sides 56 and 57 which extend therebetween. Formed entirely through the body of the pad plate 21, from the front face 50 to the rear face 51 and normal to each, is an unthreaded bore 60. Surrounding the bore 60 on the rear face 51 is a depression 61 extending approximately halfway into the thickness of the body of the pad plate 21. The depression 61 is an elongate, generally rectangular depression formed into the body of the pad plate 21 from the rear face 51 thereof. The depression 61 has a top 62 and an opposed, parallel bottom 63, and opposed and parallel sides 64 and 65. The corners between the top 62 and the sides 64 and 65 and between the bottom 63 and the sides 64 and 65 are gently rounded. The depression 61 terminates within the pad plate 21 at a seat 66 which is smooth and flat across its entirety and is parallel to the rear face 51.

The rigid member 23 is sized and shaped to snugly fit into and be seated in the depression 61 when the assembly 12 is assembled and applied to the buttstock 10. The rigid member 23 is elongate, generally rectangular, and has smooth, flat, and parallel front and rear faces 70 and 71. In other embodiments, the rigid member 23 has shapes other than rectangular. The rigid member 23 has a top 72 and an opposed and parallel bottom 73, as well as parallel sides 74 and 75 opposed from each other. Located centrally between the top 72 and bottom 73 and centrally between the sides 74 and 75 is a bore 76 formed entirely though the rigid member 23 from the front face 70 to the rear face 71, through which the adjustment bolt 24 extends. The bore 76 is not threaded. When the rigid member 23 is seated in the depression 61, it is snugly received therein. Its front face 70 is fully in contact against the seat 66 of the depression 61, and its rear face 71 is flush with the rear face 51 of the pad plate 21. The rigid member 23 is strong, rigid, and is preferably constructed from metal. It provides increased rigidity to the pad plate 21 when secured thereto.

The pad 22 is a resilient pad which absorbs the recoil force and mitigates the felt recoil. The pad 22 is preferably bonded to the rear face 51 of the pad plate 21 to affix the pad 22 to the pad plate 21. The pad 22 includes a front face 80 (shown in FIG. 2B), an opposed rear face 81 (shown in FIG. 2A), and a dense body 82 disposed therebetween. The body 82 of the pad 22 is preferably constructed from an elastometic or other material or combination of materials having properties of resiliency, durability, softness, and shape memory. Preferably, but not critically, the body 82 of the pad has a hardness of approximately Shore 15A to approximately Shore 30A. The pad 22 has a top 83, a bottom 84, and opposed left and right sides 85 and 86. An outer wall 87 extends continuously around the body of the pad 22.

With reference now just to FIG. 2B, the front face 80 of the pad 22 is recessed into the body 82 a distance. An upstanding lip 90 encircles the front face 80, thereby spacing the front face 80 back from the front-most portion of the body 82. The lip 90 is normal to the front face 80 and extends continuously around it. When the pad 22 is applied to the pad plate 21, the lip 90 seats into the recessed channel 58 of the pad plate 21. The front face 80 is planar, flat, and smooth. In the embodiment shown in FIGS. 1A and 2A-2E, the front face 80 is formed with a blind hole 94 to accommodate the adjustment bolt 24. In other embodiments, additional blind holes are formed into the front face 80 over its area to lower the weight of the pad 22 and to alter its softness. In still other embodiments, a web or grid may be formed into the front face 80 to alter the weight and softness of the pad 22. In yet still other embodiments, the body 82 of the pad 22 is formed with internal cavities to alter the softness and weight of the pad 22.

Figure 2C:
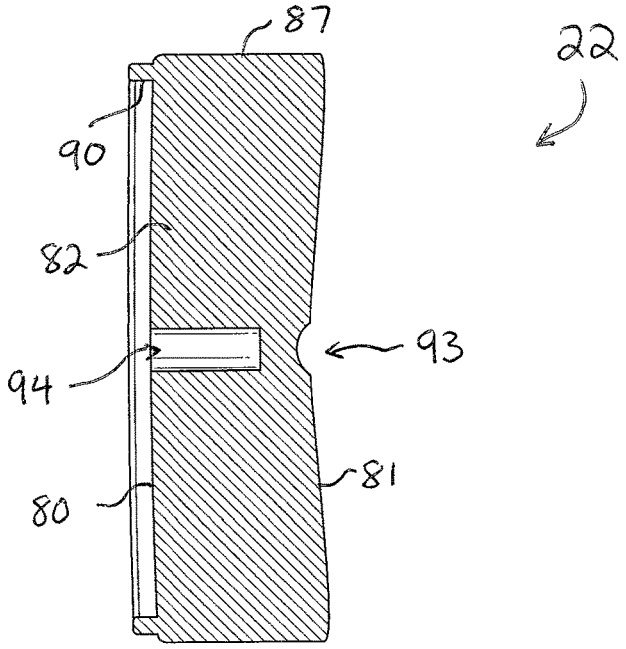
FIGS. 2C and 2E are section views of the firearm recoil pad assembly taken along the lines C-C and E-E, respectively, in FIG. 2A.

Turning back to FIG. 2A, the rear face 81 of the pad 22 carries formations which mitigate felt recoil. One of those formations, a rear perimeter edge 91, is formed at the juncture of the rear face 81 and the wall 87. The rear perimeter edge 91 is radiused to provide a smooth transition between the rear face 81 and the wall 87. As can be seen in FIGS. 2C and 2E, the rear face 81 is slightly concave, bowing inwardly into the center of the body 82 of the pad 22 from the rear perimeter edge 91.

Another of the formations which mitigates felt recoil is compression channels 92, which extend across the rear face 81. There are four compression channels 92 in the rear face 81, and each extends radially outward from a central juncture 93. There is a single, open, central depression into the body 82 at this central juncture 93. The compression channels 92 are each concave and have radiused edges or ends at their boundaries with the rear face 81. Moreover, each compression channel 92 has a width between its concave sides; that width increases gradually from the perimeter edge 91 to the central juncture 93. Where the compression channels 92 meet the perimeter edge 91 at their ends, the perimeter edge 91 is scalloped, forming a depression in the perimeter edge 91. The ends of the compression channels 92 terminate in corresponding locations: the two compression channels 92 which extend toward the top 83 terminate the same distance from the top 83, the two compression channels 92 which extend toward the bottom 84 terminate the same distance from the bottom 84, the two compression channels 92 which extend toward the left side 85 terminate the same distance from the left side 85, and the two compression channels 92 which extend toward the right side 86 terminate the same distance from the right side 86. The compression channels 92 allow the rear face 81 and the body of the pad 22 proximate to the rear face 81 to compress and deform during firing of the firearm, thereby reducing felt recoil. When the firearm 11 is fired, the sides of the concave compression channels 92 deform toward each other slightly, allowing the rear face 81 to contract slightly, collapsing the compression channels 92, and creating yield in the pad 22 in addition to the deformation of its resilient body 82.

Figure 2D:
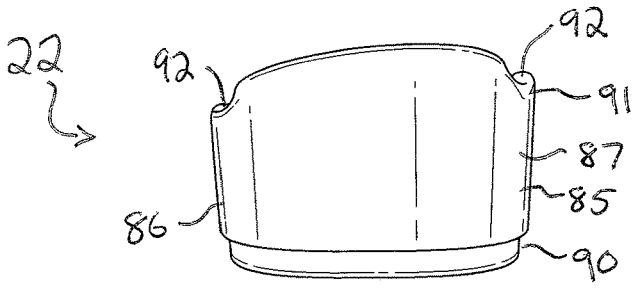
FIG. 2D is a top plan view of the firearm recoil pad assembly of FIG. 1A.
Figure 2E:
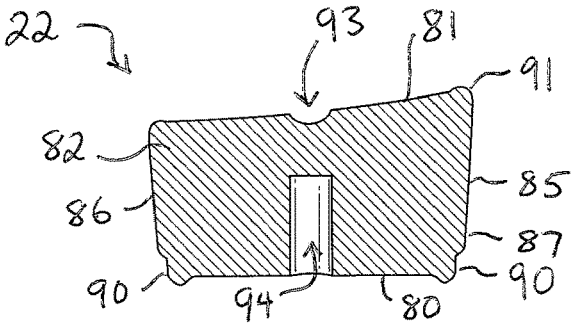

Turning now to FIG. 2D and FIG. 2E, a different profile of the pad 22 can be seen. FIG. 2D is a top plan view of the pad 22, and FIG. 2E is a section view taken along the line E-E in FIG. 2A. From the right side 86 to the left side 85 of the pad 22, the rear face 81 rises. Thus, the right side 86 of the pad is lower than the left side 85, i.e., the rear face 81 at the right side 86 of the pad 22 is closer to the front face 80 than the rear face 81 at the left side 85 of the pad 22. As can be seen in FIG. 2E, the rise is gradual and not constant (there is a depression at the central juncture 93), but the rise from the right side 86 to the left side 85 does represent an increasing thickness of the pad 22. In other words, the rear face 81 is generally canted over its width and has an angle with respect to the outer wall 87. That angle is between zero and thirty degrees, and is preferably between three and seventeen degrees. This defines the recoil pad assembly 12 as a left-hand recoil pad assembly 12, because the pad 22 is meant to be received in the left shoulder pocket, or in the area between the left shoulder and the left pectoral muscle.

Returning to FIGS. 1A, 2A, and 2B, the recoil pad assembly 12 is applied to the buttstock 10 of the firearm 11 by first placing the nut 25 in the depression 42 in the front face 30 of the base plate 20, so that the nut 25 can be interposed between the buttstock 10 and the base plate 20. The nut 25 has a thin body with an oval shape. The nut 25 includes a thin flange 100 extending radially outward from a central bore 101 through the body. The nut 25 has a flat and smooth front face 102 on the front of the flange 100. On the opposite side of the flange 100, an upstanding coaxial collar 103 projects outward, encircling the bore 101. The collar 103 terminates with a rear edge 104 defining the rear of the flange 100. The collar 103 has a reduced outer dimension with respect to the flange 100. The outer dimension or diameter of the collar 103 corresponds to the width of the slot 43 between the sides 44 and 45 thereof. The flange has two opposed parallel and flat sides 105 and 106 and two opposed arcuate sides 107 and 108. In the orientation of the nut 25 shown in FIGS. 2A and 2B, the sides 107 and 108 appear as the top and bottom of the nut 25, respectively; the side 107 is nearly semi-circular and extends between the sides 105 and 106, and the side 108 is mirror identical: nearly semi-circular and also extending between the sides 105 and 106 though opposite from the side 107. The bore 101 through the nut 25 extends through the entirety of the nut, normal to the front face 102. The bore 101 is preferably threaded so as to receive the nut 25 in threaded engagement.

The nut 25 is arranged in the base plate 20 so that its sides 105 and 106 are registered with the straight sides 44 and 45 of the depression 42. The collar 103 of the nut 25 is fit into the slot 43. The depression 42 is vertically longer (between its top 46 and bottom 47) than the nut 25 is (between its top or side 107 and bottom or side 108), and the slot 43 is also vertically longer than the outer dimension of the collar 103. The nut 25 can thus be moved vertically up and down in the depression 42, with the collar 103 moving vertically up and down in the slot 43. This allows the shooter some vertical play when setting up the assembly 12. However, the nut 25 is limited in rotating by interaction of the sides 105 and 106 against the sides 44 and 45 of the depression 42. As such, the nut 25 has adjustability in the vertical direction, but is prevented from rotating and thus from threadably disengaging from the adjustment bolt 24. When the nut 25 is fully seated into the depression 42, the front face 102 of the nut 25 is flush with the front face 30 of the base plate 20.

The base plate 20 is fastened to the buttstock 10 over the nut 25. The base plate 20 is registered with the buttstock 10, and the bolts 26 and 27 are passed through the holes 40 and 41, respectively, and then threadably engaged with the bores 15 and 16 in the buttstock 10. This secures the base plate 20 on the firearm 11.

The pad plate 21 is then registered with the base plate 20 and placed against it. The rigid member 23 is closely received and seated into depression 61 of the pad plate 21, and the adjustment bolt 24 is passed through the bore 76 in the rigid member 23 and the bore 60 in the depression 42 and then into the threaded bore 101 of the nut 25. The adjustment bolt 24 is rotated, engaging it with the nut 25 which cannot rotate. Engagement of the adjustment bolt 24 in the nut 25 binds the base plate 20, the pad plate 21, and the rigid member 23, and binds them all to the buttstock 10. With the rigid member 23 seated in the depression 42, the rigid member 23 is separated from the base plate 20 by the body of the pad plate 21.

The front face 50 of the pad plate 21 is flat and smooth, as is the rear face 31 of the base plate 20. As such, the pad plate 21 can be moved and rotated smoothly against the base plate 20 about the adjustment bolt 24. The pad plate 21 may be moved vertically with respect to the buttstock 10. This allows the shooter to vertically offset the pad plate 21 and the pad 22 for a customized fit. The shooter moves the pad plate 21 vertically by sliding the adjustment bolt 24 up and down in the slot 43, carrying the nut 25 with it.

The pad plate 21 may also be rotated with respect to the buttstock 10. This allows a shooter to adjust the pad plate 21 in various different orientations for a sure fit against his or her shoulder pocket. By rotating the pad plate 21 around the adjustment bolt 24, selecting a desired orientation of the pad plate 51, and then tightening the bolt 24 into the nut 25, the shooter can set the arrangement of the pad plate 21 and thus the pad 22. The rigid member 16, seated in the depression 61 of the pad plate 21, provides rigidity to the recoil pad assembly 12 should the shooter chose to rotate the pad plate 21 far out of alignment from the buttstock 10.

With the base plate 20 fixed on the buttstock 10 and the pad plate 21 secured on the base plate 20 with the rigid member 23 set into the pad plate 21, the pad 22 can be affixed to the pad plate 21. The shooter bonds the pad 22 to the pad plate 21. The front face 80 and upstanding lip 90 of the pad 22 are registered with the rear face 51 and perimeter edge 52 of the pad plate 21.

The upstanding lip 90 of the pad 22 mates in contact with the recessed channel 58 of the pad plate 21, and the front face 80 mates against the rear face 51 of the pad plate 21 and the rear face 71 of the rigid member 23. An adhesive applied on these faces 80, 51, and 71 bonds the pad 22 to the pad plate 21 with the rigid member 23 therebetween. In the embodiment shown in FIGS. 2A and 2B, the adjustment bolt 24 is captured under and hidden by the pad 22 within the blind hole 94. In this embodiment, the recoil pad assembly 12 is preferably adjusted as desired and then permanently set. In other embodiments, however, the blind hole 94 registered with the adjustment bolt 24 is formed entirely through the pad 22, so that the adjustment bolt 24 can be loosened and the assembly 12 may be adjusted during or between use. However, in this embodiment, the blind hole 94 is truly blind, and no through-holes are formed in the pad 22 for coupling the pad 22 to the pad plate 21. Indeed, in this embodiment, no through-holes are formed through the pad 22 at all.

As described above, the recoil pad assembly 12 is a left-hand recoil pad assembly 12, as the pad 22 is meant to be received in the left shoulder pocket. FIGS. 1B, 3A, 3B, and 3C, however, show the right-hand recoil pad assembly 13. The assembly 13 mounts to the buttstock 10 in the same way that the assembly 12 does, and indeed, includes the identical components of the base plate 20, pad plate 21, and rigid member 23. The assembly 13 also includes the identical components of the adjustment bolt 24, the nut 25, and the bolts 26 and 27. Because all of these components are identical, FIGS. 3A-3C use the same reference characters for them, and no additional description of their structure need be provided below.

However, the assembly 13 includes a right-hand recoil pad 110. The pad 110 is identical to the pad 22, but is arranged in an opposite orientation. For this reason, the same reference characters are used for the pads 22 and 110, but those of the pad 110 are marked with a prime ("') symbol, so as to designate and differentiate them from those of the pad 22. Briefly, the pad 110 of the assembly 13 includes a front face 80', rear face 81', body 82', top 83', bottom 84', sides 85' and 86', wall 87', upstanding lip 90', perimeter edge 91', compression channels 92', central juncture 93', and blind hole 94'.

Figure 3A:
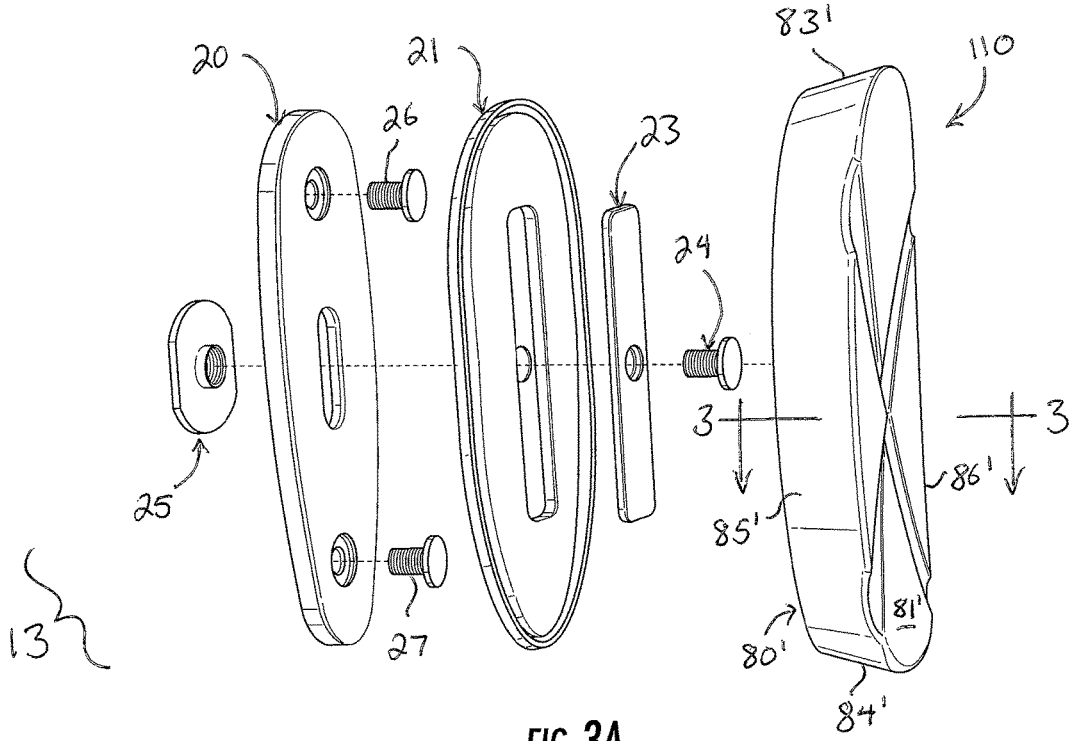
FIG. 3A is an exploded rear perspective view of the firearm recoil pad assembly of FIG. 1B.
Figure 3B:
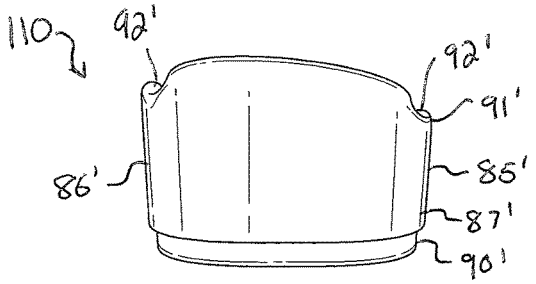
FIG. 3B is a top plan view of the firearm recoil pad assembly of FIG. 1B.
Figure 3C:
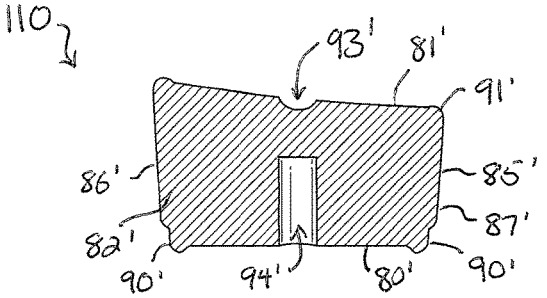
FIG. 3C is a section view of the firearm recoil pad assembly taken along the line 3-3 in FIG. 3A.
Figure 4A:
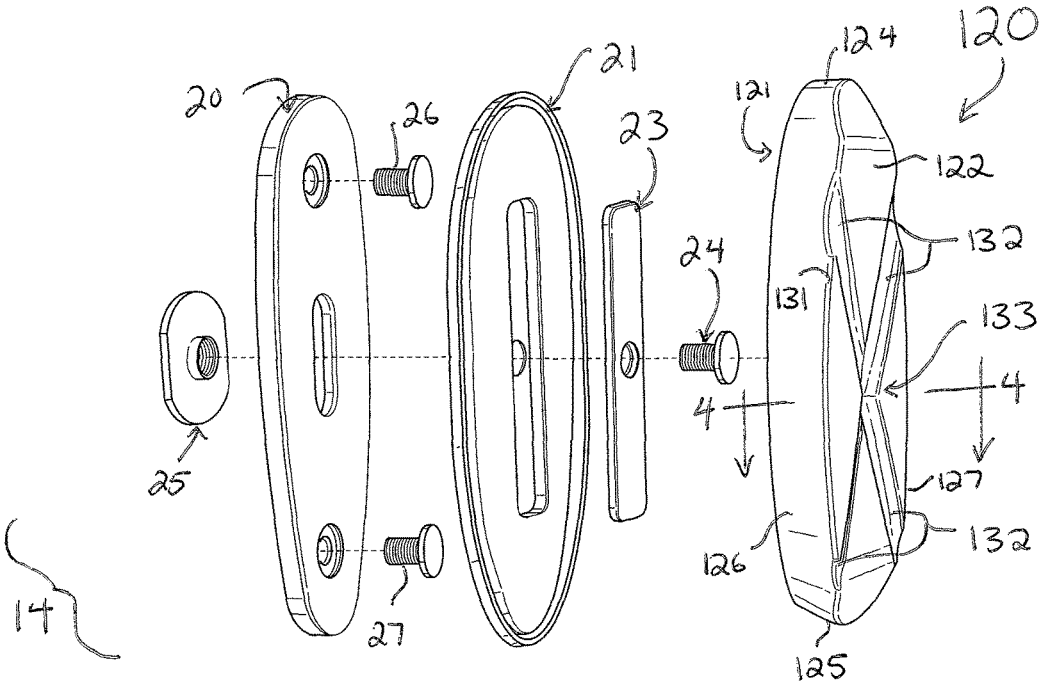
FIG. 4A is an exploded rear perspective view of the firearm recoil pad assembly of FIG. 1C.
Figure 4B:
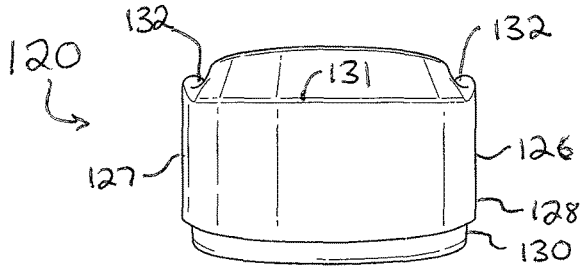
FIG. 4B is a top plan view of the firearm recoil pad assembly of FIG. 1C.
Figure 4C:
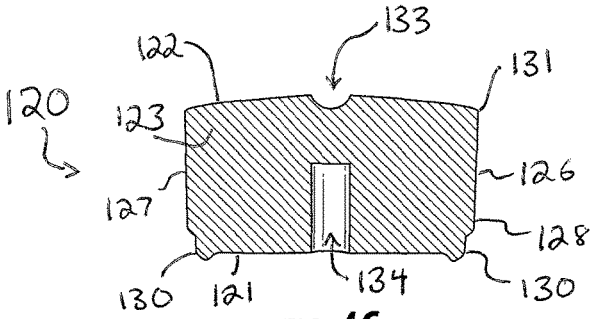
FIG. 4C is a section view of the firearm recoil pad assembly taken along the line 4-4 in FIG. 4A.

The rear face 81' of the pad 110 cants in an opposite fashion to the rear face 81 of the pad 22 between the sides 85 and 86. Simply, the pad 110 is a mirror image of the pad 22. From the left side 85' to the right side 86' of the pad 110, the rear face 81' rises. Thus, the right side 86' of the pad is higher than the left side 85', i.e., the rear face 81' at the left side 85' of the pad 110 is closer to the front face 80' than the rear face 81' at the right side 86' of the pad 110. As can be seen in FIG. 3C, the rise is gradual and not constant (there is a depression at the central juncture 93'), but the rise from the left side 85' to the right side 86' does represent an increasing thickness of the pad 110. In other words, the rear face 81 is generally canted over its width and has an angle with respect to the outer wall 87'. That angle is between zero and thirty degrees, and is preferably between three and seventeen degrees. As such, the assembly 13 is a right-hand recoil pad assembly 13, as the pad 110 is meant to be received in the right shoulder pocket, or in the area between the right shoulder and the right pectoral muscle.

FIGS. 2C, 4A, 4B, and 4C illustrate the assembly 14, useful for application to a shotgun rather than a rifle. The assembly 14 mounts to the buttstock 10 in the same way that the assembly 12 does, and indeed, includes the identical components of the base plate 20, pad plate 21, and rigid member 23. The assembly 14 also includes the identical components of the adjustment bolt 24, the nut 25, and the bolts 26 and 27. Because all of these components are identical, FIGS. 4A-4C use the same reference characters for them, and no additional description of their structure need be provided below.

However, the assembly 14 includes a unique shotgun recoil pad 120. The pad 120 is a resilient pad which absorbs the recoil force and mitigates the felt recoil. The pad 120 is bonded to the rear face 51 of the pad plate 21 and the rear face 71 of the rigid member 23, just as the pad 22 is. However, the portion of the pad 120 which interfaces with the shooter is different.

The pad 120 includes a front face 121, an opposed rear face 122, and a dense body 123 disposed therebetween. The body 123 of the pad 120 is preferably constructed from an elastometic or other material or combination of materials having properties of resiliency, durability, softness, and shape memory. Preferably, but not critically, the body 123 of the pad 120 has a hardness of approximately Shore 15A to approximately Shore 30A. The pad 120 has a top 124, a bottom 125, and opposed left and right sides 126 and 127. An outer wall 128 extends continuously around the body of the pad 120.

The front face 121 of the pad 120 is recessed into the body 123 a distance. An upstanding lip 130 encircles the front face 121, thereby spacing the front face 121 back from the front-most portion of the body 123. The lip 130 is normal to the front face 121 and extends continuously around it. The front face 121 is planar, flat, and smooth. A blind hole 134 extends into the body 123 of the pad 120 from the front face 121 thereof but does not extend through to the rear face 122. In some embodiments, where the shooter may wish to alter or reposition the assembly 14 on the firearm 11 after applying the pad 120 to the pad plate 21, the hold 134 is formed entirely through the pad 120 to the rear face 122, so that the adjustment bolt 24 can be accessed and adjusted. In other embodiments, additional blind holes are formed into the rear face 122 over its area to lower the weight of the pad 120 and to alter its softness. In still other embodiments, a web or grid may be formed into the rear face 122 to alter the weight and softness of the pad 120. In yet still other embodiments, the body 123 of the pad 120 is formed with internal cavities to alter the softness and weight of the pad 120.

The rear face 122 of the pad 120 carries formations which mitigate felt recoil. One of those formations, a rear perimeter edge 131, is formed at the juncture of the rear face 122 and the wall 128. The rear perimeter edge 131 is radiused to provide a smooth transition between the rear face 122 and the wall 128.

In addition, the top 124 and bottom 125 are deeply beveled: the top 124 has a long planer bevel of approximately fifteen degrees between the rear face 122 and the outer wall 128, and the bottom 125 has a shorter planar bevel of approximately fifteen degrees between the rear face 122 and the outer wall 128. These bevels allow the shooter to rock the shotgun vertically in his or her shoulder pocket without sacrificing the direct contact area between the pad 120 and the shoulder pocket. The rear face 122 is very slightly convex in its vertical dimension or height, bowing inwardly into the body of the pad 120 from the rear perimeter edge 131 and the bevels at the top 124 and bottom 125. The rear face 122 is preferably convex in its horizontal dimension or width between the sides 126 and 127. In some embodiments, however, the rear face 122 rises or is canted.

Another of the formations which mitigates felt recoil is the compression channels 132 that extend across the rear face 122. There are four compression channels 132 in the rear face 122; each extends radially outward from a central juncture 133 and terminates at the bevel at the top 124 or just above the bevel at the bottom 125. There is a single open central depression into the body 123 at this central juncture 133. The compression channels 132 are each concave and have radiused edges or ends at their boundaries with the rear face 122. Moreover, each compression channel 132 has a width between its concave sides; that width increases gradually from the perimeter edge 91 to the central juncture 93. Where the compression channels 132 meet the perimeter edge 131 at their ends, the perimeter edge 131 is scalloped, forming a depression in the perimeter edge 131. The ends of the compression channels 132 terminate in corresponding locations: the two compression channels 132 which extend toward the top 124 terminate the same distance from the top 124, the two compression channels 132 which extend toward the bottom 125 terminate the same distance from the bottom 125, the two compression channels 132 which extend toward the left side 126 terminate the same distance from the left side 126, and the two compression channels 132 which extend toward the right side 127 terminate the same distance from the right side 127. The compression channels 132 allow the rear face 122 and the body of the pad 120 proximate to the rear face 122 to compress and deform during firing of the firearm, thereby reducing felt recoil. When the firearm 11 is fired, the sides of the concave compression channels 132 deform toward each other slightly, allowing the rear face 122 to contract slightly, collapsing the compression channels 132, and creating yield in the pad 120 in addition to the deformation of its resilient body 123.

A preferred embodiment is fully and clearly described above so as to enable one having skill in the art to understand, make, and use the same. Those skilled in the art will recognize that modifications may be made to the description above without departing from the spirit of the invention, and that some embodiments include only those elements and features described, or a subset thereof. To the extent that modifications do not depart from the spirit of the invention, they are intended to be included within the scope thereof.

The invention claimed is:

1. A firearm recoil pad assembly, comprising:

a base plate for a firearm, the base plate having a bore formed therethrough, wherein the bore is a slot, and a depression is formed into the base plate around the slot;

a pad plate having a bore formed therethrough;

a bolt and a nut, the bolt extending through the bores in the base plate and in the pad plate, and coupling with the nut to thereby secure the pad plate to the base plate;

the nut has an oval shape, comprising a thin flange extending outward from a central bore and having two opposed parallel sides and two opposed arcuate sides, and an upstanding coaxial collar;

the nut is fit to the base plate, with the flange seated in the depression and the collar seated in the slot; and a pad affixed to the pad plate, the pad having a rear face formed with compression channels extending across the rear face.

2. The firearm recoil pad assembly of claim 1, wherein the compression channels extend radially outward from a central juncture on the rear face of the pad.

3. The firearm recoil pad assembly of claim 1, wherein the pad is formed without any through-holes for coupling the pad to the pad plate.

4. The firearm recoil pad assembly of claim 1, wherein the pad has opposed left and right sides, and the rear face is canted toward one of the left and right sides.

5. The firearm recoil pad assembly of claim 1, further comprising:

a rigid member; and a depression formed into the pad plate, wherein the depression closely receives the rigid member.

6. The firearm recoil pad assembly of claim 1, further comprising:

a rigid member, and a depression formed into the pad plate, wherein the depression closely receives the rigid member; and the rigid member is separated from the base plate by the pad plate.

7. The firearm recoil pad assembly of claim 1, wherein:

the pad plate has a recessed channel; and the pad has a complemental upstanding lip which is received in the recessed channel when the pad is applied to the pad plate.

8. A firearm recoil pad assembly, comprising:

a base plate carrying fasteners for securing the base plate to a firearm, the base plate having a bore formed therethrough, wherein the bore is a slot, and a depression is formed into the base plate around the slot;

a pad plate having a bore formed therethrough;

a bolt and a nut, the bolt extending through the bores in the base plate and in the pad plate, and coupling with the nut to thereby secure the pad plate to the base plate;

the nut has an oval shape, comprising a thin flange extending outward from a central bore and having two opposed parallel sides and two opposed arcuate sides, and an upstanding coaxial collar;

the nut is fit to the base plate, with the flange seated in the depression and the collar seated in the slot;

a pad affixed to the pad plate, the pad comprising:

a rear face formed with compression channels extending across the rear face; and opposed left and right sides, wherein the rear face is canted toward one of the left and right sides.

9. The firearm recoil pad assembly of claim 8, wherein the compression channels extend radially outward from a central juncture on the rear face of the pad.

10. The firearm recoil pad assembly of claim 8, wherein the pad is formed without any through-holes for coupling the pad to the firearm recoil pad assembly.

11. The firearm recoil pad assembly of claim 8, further comprising the bores of the base plate and the pad plate are formed normally through each.

12. The firearm recoil pad assembly of claim 8, further comprising:

a rigid member; and a depression formed into the pad plate, wherein the depression closely receives the rigid member.

13. The firearm recoil pad assembly of claim 8, further comprising:

a rigid member, and a depression formed into the pad plate, wherein the depression closely receives the rigid member; and the rigid member is separated from the base plate by the pad plate.

14. The firearm recoil pad assembly of claim 8, wherein:

the pad plate has a recessed channel; and the pad has a complemental upstanding lip which is received in the recessed channel when the pad is applied to the pad plate.

15. A firearm recoil pad assembly, comprising:

a base plate carrying fasteners for securing the base plate to a firearm, the base plate having a bore formed therethrough, wherein the bore is a slot, and a depression is formed into the base plate around the slot;

a pad plate having a bore formed therethrough;

a rigid member having a bore formed therethrough;

a bolt and a nut, the bolt extending through the bores in the base plate, the pad plate, and the rigid member, and coupling with the nut to thereby secure the pad plate to the base plate;

the nut has an oval shape, comprising a thin flange extending outward from a central bore and having two opposed parallel sides and two opposed arcuate sides, and an upstanding coaxial collar;

the nut is fit to the base plate, with the flange seated in the depression and the collar seated in the slot; and a pad affixed to the pad plate, the pad having a rear face formed with compression channels extending across the rear face.

16. The firearm recoil pad assembly of claim 15, wherein the compression channels extend radially outward from a central juncture on the rear face of the pad.

17. The firearm recoil pad assembly of claim 16, wherein the pad is formed without any through-holes for coupling the pad to the firearm recoil pad assembly.

18. The firearm recoil pad assembly of claim 17, further comprising the bores of the base plate and the pad plate are formed normally through each.

19. The firearm recoil pad assembly of claim 18, wherein:

the pad plate has a recessed channel; and the pad has a complemental upstanding lip which is received in the recessed channel when the pad is applied to the pad plate.

* * * * *